US005887467A

United States Patent [19]

Butterweck et al.

[11] Patent Number: 5,887,467

[45] Date of Patent: Mar. 30, 1999

[54] PAWL & SOLENOID LOCKING MECHANISM

[75] Inventors: Dieter Butterweck, Dortmund, Germany; Peter J. Phillips, Rancho P V; Klaus W. Gartner, Palos Verdes Estates, both of Calif.

[73] Assignee: U-Code, Inc., Torrance, Calif.

[21] Appl. No.: 890,017

[22] Filed: Jul. 10, 1997

Related U.S. Application Data

[63] Continuation-in-part of Ser. No. 377,818, Jan. 25, 1995, abandoned, which is a continuation-in-part of Ser. No. 219,785, Mar. 30, 1994, abandoned.

[51] Int. Cl.[6] ..... E05B 49/00

[52] U.S. Cl. ..... 70/278; 70/133; 292/144

[58] Field of Search ..... 70/119, 133, 108, 70/156, 271, 277, 278, 286, 445; 292/144, 139, 140

[56] References Cited

U.S. PATENT DOCUMENTS

| | | | |
|---|---|---|---|
| D. 354,922 | 1/1995 | Gartner | D10/106 |
| 419,903 | 1/1890 | Wilkins . | |
| 446,509 | 2/1891 | Colby | 70/278 |
| 473,800 | 4/1892 | Van Broek . | |
| 793,087 | 6/1905 | McVitty . | |
| 1,103,116 | 7/1914 | Wehner . | |
| 1,179,099 | 4/1916 | Hayashi . | |
| 1,270,372 | 6/1918 | Breirather . | |
| 1,530,861 | 3/1925 | Standen . | |
| 1,601,024 | 9/1926 | Jacobson | 292/144 |
| 1,876,193 | 9/1932 | Wolters . | |
| 2,466,481 | 4/1949 | Royal . | |
| 2,765,648 | 10/1956 | Hatcher | 292/144 |
| 2,810,600 | 10/1957 | Kendrick . | |
| 2,940,292 | 6/1960 | Heath | 292/144 |
| 3,099,150 | 7/1963 | Check . | |
| 3,447,347 | 6/1969 | Kawamura | 70/157 |
| 4,019,355 | 4/1977 | Germanton | 70/278 |
| 4,073,167 | 2/1978 | Bates, II | 70/133 |
| 4,114,408 | 9/1978 | Gee | 70/128 |
| 4,148,092 | 4/1979 | Martin | 361/172 |
| 4,220,022 | 9/1980 | Willach | 70/278 |
| 4,422,312 | 12/1983 | Chermoni | 70/133 |
| 4,457,144 | 7/1984 | Johansson et al. | 70/278 |
| 4,633,687 | 1/1987 | Fane | 70/276 |
| 4,648,636 | 3/1987 | Reynard | 292/39 |
| 4,665,727 | 5/1987 | Uyeda | 70/279 |
| 4,669,394 | 6/1987 | Fogleman et al. | 109/59 |
| 4,727,301 | 2/1988 | Fulks et al. | 318/468 |
| 4,736,970 | 4/1988 | McGourty et al. | 292/359 |
| 4,745,784 | 5/1988 | Gartner | 70/277 |
| 4,754,625 | 7/1988 | McGourty et al. | 70/214 |
| 4,762,212 | 8/1988 | Fish et al. | 192/24 |
| 4,770,012 | 9/1988 | Johansson et al. | 70/278 |
| 4,799,371 | 1/1989 | Duncan | 70/214 |
| 4,831,851 | 5/1989 | Larson | 70/303 |
| 4,838,052 | 6/1989 | Williams et al. | 71/63 |
| 4,887,445 | 12/1989 | Beatty | 70/278 |
| 4,899,562 | 2/1990 | Gartner et al. | 70/277 |
| 4,901,545 | 2/1990 | Bacon et al. | 70/278 |
| 4,904,984 | 2/1990 | Gartner et al. | 340/543 |
| 4,926,664 | 5/1990 | Gartner et al. | 70/119 |
| 4,956,985 | 9/1990 | Kim | 70/313 |

(List continued on next page.)

FOREIGN PATENT DOCUMENTS

| | | |
|---|---|---|
| 895629 | 3/1972 | Canada . |
| 4033008 C | 12/1991 | Germany . |
| 2000217 | 1/1979 | United Kingdom . |

*Primary Examiner*—Steven Meyers
*Assistant Examiner*—Gary Estremsky
*Attorney, Agent, or Firm*—Oppenheimer Wolff & Donnelly LLP

[57] ABSTRACT

An apparatus for an electronic lock having a movable bolt including a spring biased pawl movable when it is released by a solenoid mechanism for relative movement by the bolt as the bolt is moved from a blocked entrance way position to an unblocked entranceway position.

18 Claims, 7 Drawing Sheets

U.S. PATENT DOCUMENTS

| | | | |
|---|---|---|---|
| 4,967,577 | 11/1990 | Gartner et al. | 70/279 |
| 5,033,282 | 7/1991 | Gartner et al. | 70/278 |
| 5,058,404 | 10/1991 | Fish et al. | 70/315 |
| 5,061,923 | 10/1991 | Miller et al. | 340/825.31 |
| 5,133,265 | 7/1992 | Lahti et al. | 105/96 |
| 5,216,909 | 6/1993 | Armoogam | 292/144 |
| 5,437,174 | 8/1995 | Aydin | 70/278 |
| 5,473,922 | 12/1995 | Bair et al. | 70/416 |
| 5,475,996 | 12/1995 | Chen | 70/277 |
| 5,588,318 | 12/1996 | Osborne | 292/144 |
| 5,605,066 | 2/1997 | Hurskainen | 70/278 |
| 5,638,708 | 6/1997 | Hsu | 70/84 |

14
18
24
26
28
30
34
38
40
42
44
46
66
70
72
74
76
78
80
82

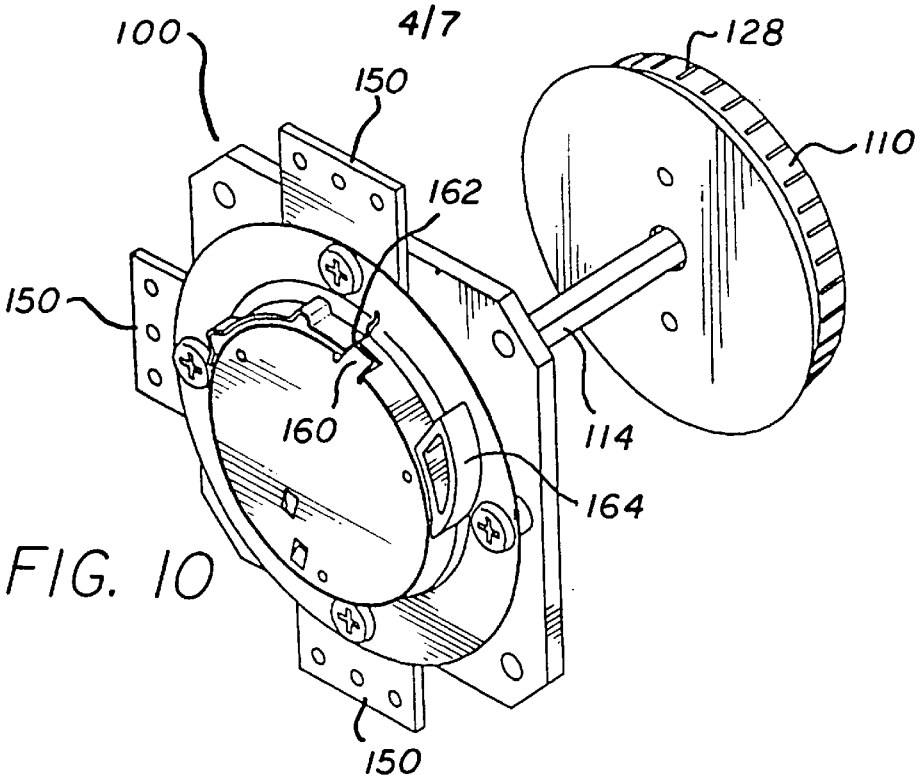
FIG. 10
FIG. 11
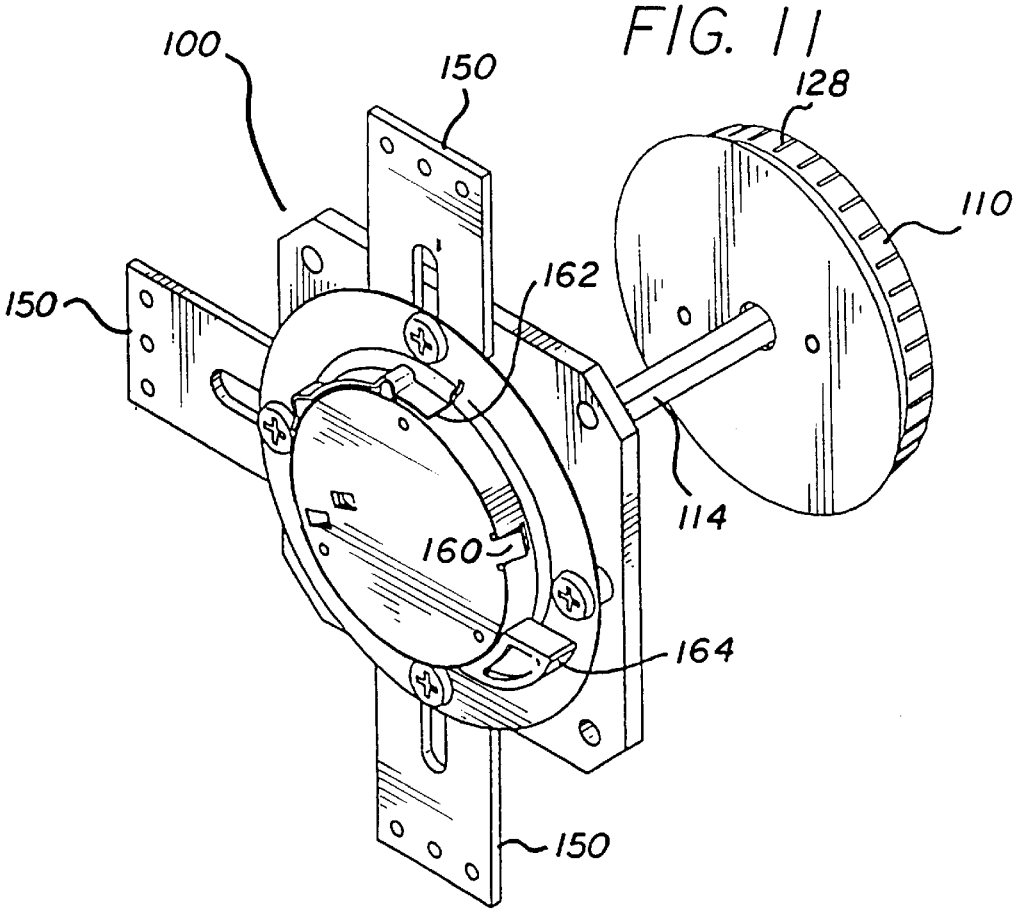

5/7

154
160
156
152
162
108
148
156
146
118
106
158
142
144
134
138
140
164
104
136
150
150
130
120
102
122
130
124
126
124
132
132
112
132
132
130
124
100
116
150

PAWL & SOLENOID LOCKING MECHANISM

This is a continuation-in-part application of parent application assigned Ser. No. 08/377,818 entitled "ELECTRONIC INPUT AND DIAL ENTRY LOCK," filed Jan. 25, 1995, by the same inventors and now abandoned which is a continuation-in-part application of application assigned Ser. No. 08/219,785, entitled "ELECTRONIC INPUT AND DIAL ENTRY LOCK," filed Mar. 30, 1994, by the same inventors and now abandoned.

BACKGROUND OF THE INVENTION

1. Field of the Invention

The present invention relates to combination locks. More precisely, the present invention relates to an electronic push button lock, having a pawl and solenoid locking mechanism to prevent lock handle rotation from the open or closed condition in the absence of a correct combination code being entered by a user.

2. Prior Art and Related Information

Electronic locks have gained wide popularity for several reasons. First, it is usually less expensive to fabricate the electronics necessary to decipher an open combination than it is to machine and assemble mechanical parts to perform the same finction. Second, the material and labor costs involved in manufacturing an electronic lock tend to be lower as compared to a completely mechanical combination lock.

Third, an electronic lock is sometimes superior to a mechanical lock in defeating a potential safe cracker. For example, it is sometimes possible to manipulate a mechanical combination lock by relying on sounds generated by the moving tumblers inside, thereby obtaining the correct combination through sounds. On the other hand, an electronic lock deciphers the dial-in combination without moving parts and therefore does not serve as a feedback mechanism to assist the safecracker in breaching the lock.

Fourth, electronic locks are popular in that they can be easily reprogrammed to change the combination when necessary. The reprogramming is easy to accomplish electronically perhaps with only a few keypunches. In contrast, a mechanical door lock requires disassembly of certain portions of the lock cylinder. In a hotel room setting, an electronic lock that is easily reprogrammed is significantly more advantageous than a key lock, for instance, because the former can be reprogrammed if the key to the lock is lost or stolen.

There are many variations of electronic locks in the art. For example, U.S. Pat. No. 4,665,727 to Uyeda discloses an electronic digital safe lock including a slide plate pivotally connected by an articulated linkage to a bolt operating lever for retracting the safe door locking bolts after digital input of the electronic lock combination. The invention of Uyeda further includes a mechanical bypass system wherein a manual combination lock can be manipulated to release the locked bolt.

U.S. Pat. No. 4,745,784 to Gartner discloses an electronic dial combination lock having a spindle journalled within the lock for movement within two degrees of freedom; i.e., rotational and axial displacement to cause engagement of a push pin located on an internal cam wheel to engage one of a plurality of pressure-sensitive switches within the lock. Each switch is capable of making a discrete electrical connection. Circuitry is included to detect when a predetermined, sequential order corresponding to the lock's combination is input through the pressure-sensitive switches. Gartner replaces conventional combination locks which typically comprise a plurality of tumbler wheels coaxially journalled on a rotating spindle which projects outwardly from the lock and is manipulated within one degree of freedom (rotational) through a predetermined, sequential series of rotations to operate a bolt within the lock.

U.S. Pat. No. 4,831,851 to Larson discloses a lock mechanism having a mechanical combination lock and an electronic lock, wherein the mechanical combination lock serves as a fail safe entry in case of failure of the electronic lock. In that same vein, U.S. Pat. No. 4,967,577 to Gartner et al. discloses an electronic lock with a manual combination override for opening of a lock by both an electronic and manual means.

A variation of an electronic door lock is provided in U.S. Pat. No. 4,899,562 to Gartner et al., wherein a single control knob is used for entering a predetermined combination through manipulation of the knob in a first arc of rotation, the code being entered by pushing the dial inwardly to bring a push pad into contact with individual switches in an array of electrical switches provided on a printed circuit board within the lock housing. The release of the door locking bolt is accomplished after entry of the predetermined code by further manipulation of the control knob through remaining portions of the knob rotations which were unavailable until after entry of the predetermined code. An alternative manner of entering the code for the electronic lock is provided through digital input pads located on the escutcheon.

In electronic locks, generally, the singular bolt or latch is mechanically operated. The electronic portion of the lock controls a solenoid which blocks or unblocks movement of the bolt thereby permitting the bolt to be respectively disabled or operated. Locks can have multiple bolt configurations, especially in a circular shape door for a safe. Typically, the bolts extend radially and are operated by a centrally located, rotating gear, cam, disk or the like. Examples of such multiple bolt locks include U.S. Pat. No. 4,127,995 to Miller, U.S. Pat. No. 4,342,207 to Holmes et al., and U.S. Pat. No. 4,493,199 to Uyeda.

An example of a solenoid-operated lock is U.S. Pat. No. 4,904,984 to Gartner et al. The patent teaches a combination lock with an additional security lock wherein an electrically operable solenoid, having an armature post normally biased outward of a solenoid body, is mounted to the combination lock housing so as to position the armature post normally to block movement of either the combination lock bolt or the bolt release lever associated with the bolt. An electrical signal generator is used to selectively operate the solenoid to retract the post from a bolt and/or bolt release lever blocking position to allow operation of the combination lock.

An electronic lock has its limitations. In a typical keypad code entry electronic lock, for example, it is often difficult by sight to determine if the locking bolt is in the retracted or extended position. Because the dial in prior art mechanical locks are often replaced by a digital keypad, there are no visual indications as to the locked or unlocked condition of the lock. Thus, someone who is distracted or absent-minded might easily leave the electronic lock in the open position; conversely, the electronic lock might be locked accidentally because the user was not aware of its locked condition based solely on any visual cues.

Therefore, a need presently exists for an electronic keypad operated combination lock wherein the keypad is merged into the handle. By virtue of the indicia on the keypad, it is possible to instantly recognize the open or closed condition of the lock based on the orientation of the indicia.

SUMMARY OF THE INVENTION

In view of the foregoing, it is therefore an object of the present invention to provide an electronic combination lock having a keypad with push buttons bearing indicia that indicate an open or closed condition of the lock. It is another object of the present invention to provide an electronic combination lock wherein the digital keypad is incorporated into the handle that operates the bolt. It is still yet another object of the present invention to provide an electronic combination lock having a housing that attaches through unidirectional rotation onto bolts on a door to which the lock is to be mounted. It is still another object of the present invention to provide a handle having a dial shape and incorporating a manual keypad therein, which handle when rotated retracts the locking bolt. It is yet another object of the present invention to provide an electronic lock having a power level indicator, and backup electrical contacts for connection to an outside power source in case of a power failure of the internal power source.

To achieve the foregoing objects, the present invention in a preferred embodiment provides a combination lock for mounting on a door comprising a handle having a keypad with keys, bearing indicia, for entering a code, wherein the handle is attached to a shaft rotated by the handle. A bolt having an extended position and a retracted position is selectively operated by rotation of the handle, whereby an orientation of the indicia selectively indicates the extended position and retracted position of the bolt. An electromagnetically operated bolt blocking device selectively blocks and unblocks movement of the bolt, while a controller receives the entered code from the keypad and provides a control signal, wherein the control signal triggers the bolt blocking device to unblock the bolt, and movement of the bolt is consequently enabled so that rotation of the handle moves the bolt to the retracted position.

The preferred embodiment of the present invention electronic combination lock is powered by a battery. The dial face includes electrical contacts that allow for connection to an outside electrical source in case the internal battery fails. As a safety precaution, the present invention preferably includes a battery power indicator located on the dial face to warn of a drained power supply.

In prior art devices, the electronic keypad is immobile. Furthermore, in conventional electronic locks, the keypad is separate from the handle used to operate the locking bolt. The present invention therefore provides a unique and clever electronic lock wherein the keypad for entering an open code also serves as an indicator of the open or closed condition of the lock. The dial-like structure surrounding the keypad further serves as a handle to open and close the lock bolt.

In an alternative embodiment, the present invention as described above is adapted to a boltworks configuration to operate a plurality of bolts. Specifically, the shaft that is rotated by the round, dial-like handle is connected to a gear that rotates as the shaft rotates. A plurality of radially extending bolts each having a rack engaging teeth on the gear can be extended or retracted in accordance with the rotation of the gear. By enabling or disabling rotation of the shaft, it is possible to freeze the position of the plurality of bolts, thereby maintaining the bolts in an extended and locked state, or in a retracted and unlocked state.

In order to prevent rotation of the shaft, the present invention in a preferred embodiment utilizes a sliding dog that extends from a rotatable member that rotates with the shaft. When the sliding dog is extended and engages an immobile structure surrounding the rotatable member, further rotation of the rotatable member and the associated shaft is prevented. Disengaging the sliding dog from the surrounding immobile structure permits rotation of the rotatable member and the associated shaft. Therefore, after the correct combination has been punched into a keypad in the handle, a solenoid releases the sliding dog which retracts to permit rotation of the rotatable member. Now, rotating the handle turns the shaft, which turns the gear to operate the radially extending bolts to unlock the device.

In another alternative embodiment, a lockable pawl is mounted to a slidable bolt plate that moves between open and close positions in response to the rotation of a rotatable key pad handle assembly. The pawl is urged outwardly form the bolt plate to engage a detent in a fixed base plate to substantially prevent relative movement between the bolt plate and the base plate when the pawl is in a locked position. A solenoid pin actuated by a solenoid engages a detent in the pawl to secure it in a locked position to prevent rotation of the keypad handle assembly until a correct combination code is entered.

BRIEF DESCRIPTION OF THE DRAWINGS

The objects, features and advantages of the present invention will be apparent to one skilled in the art from reading the following detailed description in which:

FIG. 10 is a perspective of an alternative embodiment of the present invention showing the electronic combination lock adapted for use with a boltworks mechanism with the plurality of bolts retracted;

FIG. 11 shows the present invention in a locked position with the plurality of bolts extended;

DETAILED DESCRIPTION OF THE INVENTION

The following specification describes an electronic lock with a digital keypad incorporated into the handle. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

The present invention relates to an electronic combination lock disposed on a door comprising a handle having a keypad with keys bearing indicia for entering a combination code, a shaft rotated by the handle mounted to the door, and a bolt having an extended position and a retracted position, selectively operated by rotation of the handle whereby an orientation of the indicia selectively indicates the extended position or retracted position of the bolt. An electromagnetically operated bolt blocking device is used to selectively block and unblock movement of the bolt based on a controller receiving the proper code entered from the keypad. Specifically, upon receipt of the proper code, the controller provides a control signal that triggers the bolt blocking device to unblock the bolt, thereby enabling movement of the bolt by rotation of the handle to displace the bolt to the retracted position.

Figure 1:
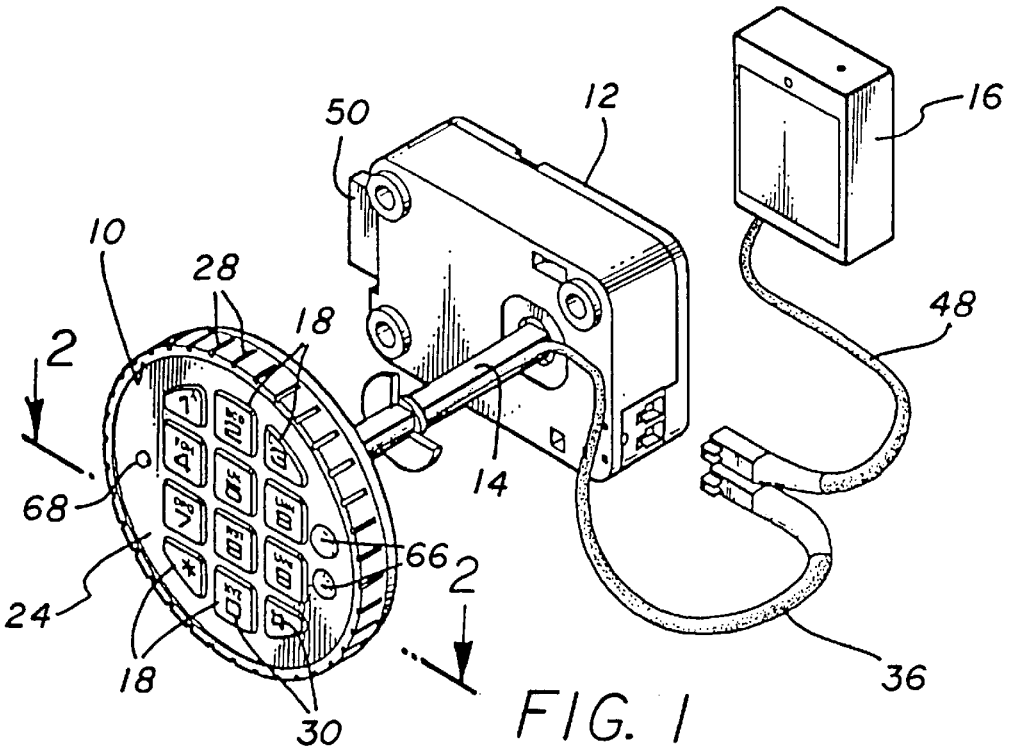
FIG. 1 is a perspective view of the present invention electronic combination lock showing a dial shape handle having a digital keypad incorporated therein, said handle connected to a shaft to operate a lock, and the lock being powered by a battery pack.

FIG. 1 shows a preferred embodiment of the present invention electronic lock. In the preferred embodiment, the electronic lock has preferably three major components including a handle 10 connected to a lock 12 through a shaft 14, powered by a battery pack 16 containing a DC cell.

In the preferred embodiment, the handle 10 is fashioned into a round dial shape with ridges 28 around the circumference. Incorporated into the face plate 24 of the handle 10 is a keypad comprised of individual push buttons 18. Each push button 18 optionally bears indicia 30 such as numbers, letters, symbols, and like alphanumeric representations.

For the present invention electronic combination lock, the push buttons 18 are used to enter a preset combination code to open the lock. In addition, as discussed in detail below, the orientation of the indicia 30 gives the user an indication of the open or closed condition of the lock. To that end, in an alternative embodiment, the individual keys may be formed into unique shapes that give the user a frame of reference without need for imprinted or embossed indicia.

Figure 2:
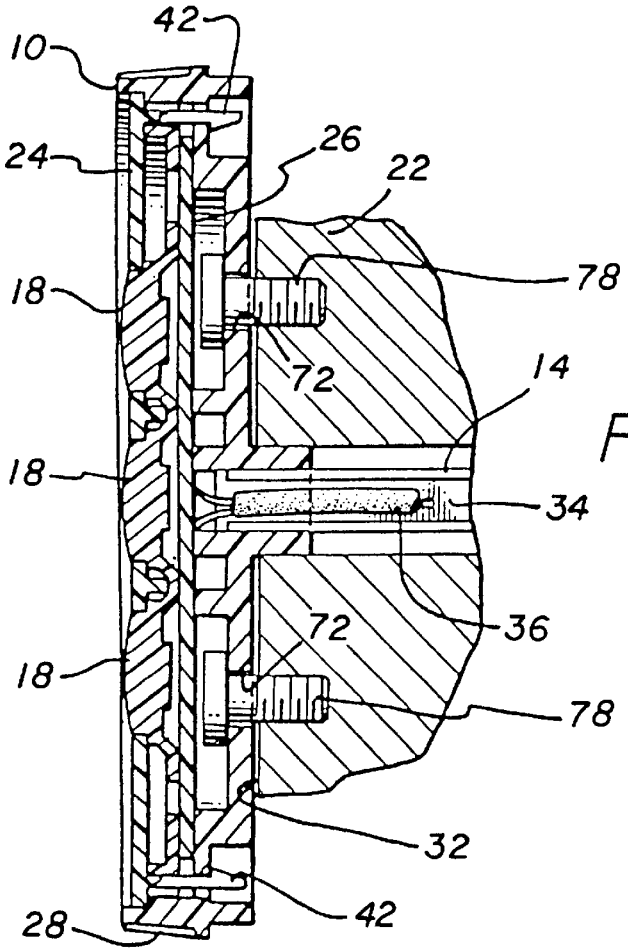
FIG. 2 is a cross-sectional view of the dial-shape handle shown in FIG. 1 taken along line 2—2.

As partially illustrated in FIG. 2, the handle 10 is mounted on an exterior 32 of a door 22 while the lock 12 and battery pack 16 are preferably located on the interior side of the door 22. Being on the interior side of the door protects the hardware from unauthorized tampering.

The present invention is useful in a variety of applications. Therefore, the door 22 may be part of a safe, a hotel room door, a locker door, a security gate, a lock box, a vault door, a front door of a residence, etc.

As mentioned above, the handle 10 is connected to the lock 12 through a shaft 14 which includes an optional channel 34 extending the length thereof. As seen in FIG. 2, the channel 34 is needed so that the electrical cable 36 interconnecting the circuitry in the handle 10 to the lock 12 can be protected from torsional forces when the handle 10 and the shaft 14 are rotated.

Figures 7, 8, 9:
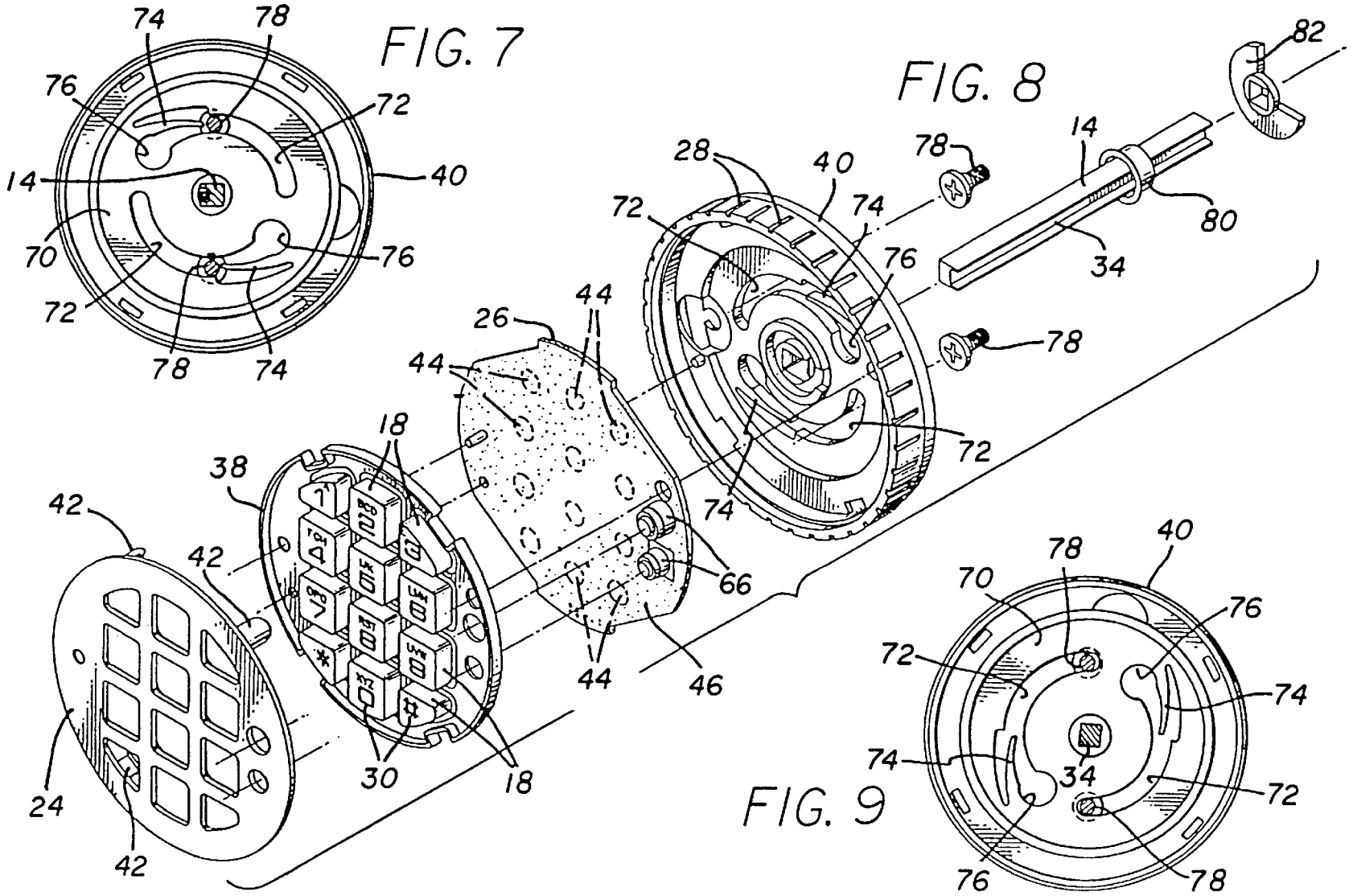
FIG. 7 is a front view of the dial housing showing two curved mounting slots, wherein each slot includes a cantilevered finger biased to extend into the curved slot.
FIG. 8 is an exploded perspective view of the dial shape handle assembly and shaft.
FIG. 9 is another view of the dial housing shown in FIG. 7, wherein the dial housing has been rotated counterclockwise 90 degrees.

FIG. 8 illustrates the major components of the handle 10, including a face plate 24, the keypad 38 with push buttons 18, a printed circuit board 26, and a round, dial-shape housing 40. In this exemplary embodiment, the foregoing parts are snapped together using snap-on hooks 42 as best illustrated in FIGS. 8 and 2. On the other hand, other fastening means for assembling the major components together known in the art, such as screws or cement, can be used as well.

The keypad 38 includes individual push buttons 18 that when depressed by a finger actuate contact switches 44, preferably located beneath a membrane 46. The contact switches 44 are disposed on the printed circuit board 26, which carries the electronics for the lock. Power for the printed circuit board 26 is preferably supplied by the battery pack 16 via cables 48 and 36. The membrane covered contact switches 44 are of a type generally known in the art.

In the present exemplary embodiment, the contact switches 44 comprise mechanical switches including a movable spring arm contact positioned over a stationary contact. The pressure sensitive switches 44 are used to complete an electrical circuit provided in a known manner on the printed circuit board 26.

The printed circuit board 26 includes circuitry known in the art for sensing electrical connections completed by depressing the contact switches 44, and detecting when a given series of connections have been made in a predetermined, sequential order corresponding to a code or combination for the lock. Once this occurs, the printed circuit board 26 generates an electrical control signal, such as a square wave, spike, or ramp, to operate the lock. In an alternative embodiment, the printed circuit board may carry a sophisticated microprocessor with a nonvolatile random access memory, known in the art, if a more complex, user programmable combination scheme is desired.

Figure 4:
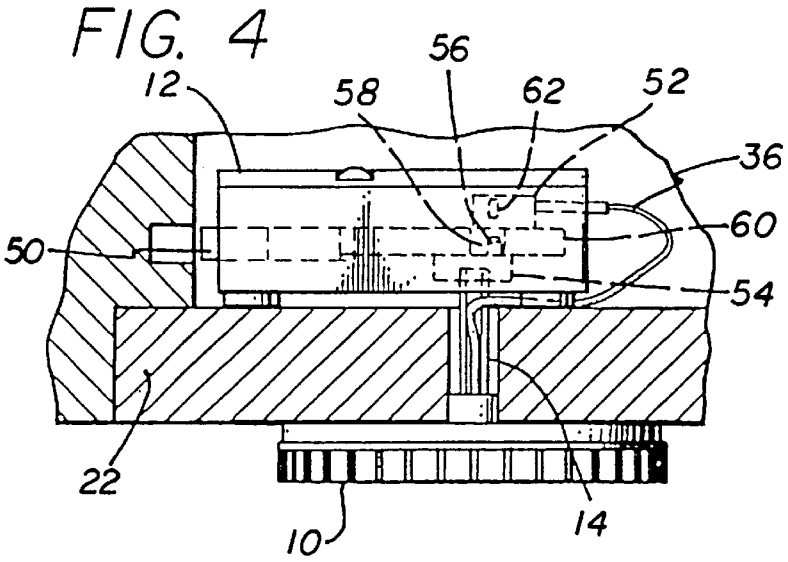
FIG. 3 and FIG. 4 are partial sectional views of the present invention combination lock installed on a door, showing the bolt in its extended and retracted positions, respectively.
Figure 3:
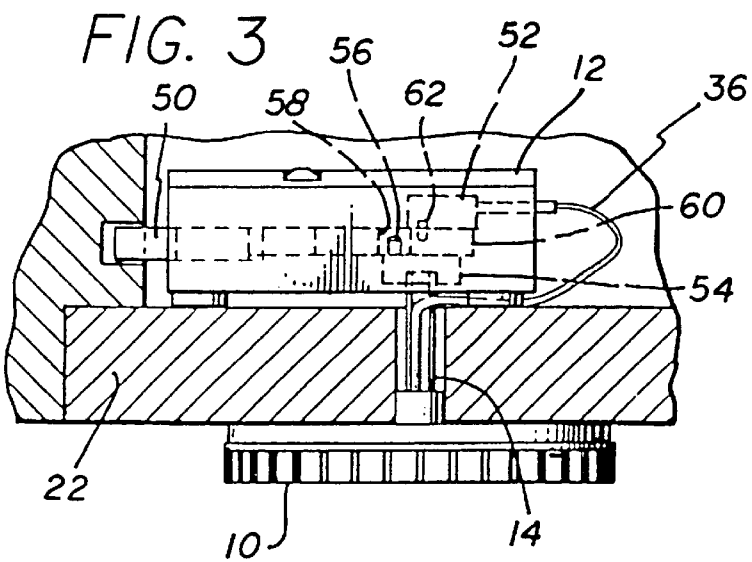

As best seen in FIGS. 3 and 4, the control signal is conveyed via cable 36 to a solenoid 52 located inside the lock 12. Within the solenoid 52 is preferably an electromagnetically operated bolt blocking device 62 that moves into a blocked or unblocked position based on whether an inductor in the solenoid 52 is energized or not. The principle behind the solenoid is well-known and need not be explained further here.

Importantly, the blocked and unblocked positions of the bolt blocking device 62 disable or enable movement of a locking bolt 50. In the preferred embodiment, the lock 12 includes the bolt 50 operated by rotation of the handle 10 and the shaft 14. As shown in FIGS. 3 and 4, the end of the shaft 14 includes a wheel 54 having an outward extending pin 56. The pin 56 slides along a straight slot 58 formed into a transitional element 60.

Thus, when the handle 10 rotates the shaft 14, the wheel 54 rotates the pin 56 in an arcuate path. In turn, the pin 56 slides along the slot 58 while simultaneously forcing the translational element 60 to move laterally, as shown in the top views of FIGS. 3 and 4, to the left or right depending on the direction of rotation of the wheel 54. Still in the top view of FIGS. 3 and 4, the foregoing occurs because while the pin 56 is displaced through an arcuate path by rotation of the wheel 54, it is simultaneously moving freely vertically along the slot 58, but engages the translational element 60 in the horizontal component of its path. Thus, the horizontal component of the motion of the pin 56 is transferred to the translational element 60, causing the latter to move laterally.

In other words, the translational element 60 converts the rotational motion of the handle 10 and shaft 14 to a lateral, translational motion. The lateral motion of the translational element 60 causes the bolt 50, which is connected thereto, to either extend out or retract back into the lock 12, as shown in FIGS. 3 and 4, respectively.

Based on whether or not the solenoid 52 is energized, the bolt blocking device 62 selectively engages or disengages from the translational element 60. Preferably, as shown in FIG. 3, the bolt blocking device 62, which may be a spring-loaded, electromagnetic pin, engages the translational element 60 thereby preventing its lateral movement, even under torque from the shaft 14 and handle 10. Under these conditions, the bolt 50 is extended into the door frame 64 and the door 22 is effectively locked.

On the other hand, when the printed circuit board 26 generates the control signal after the proper code is entered, the solenoid 52 is energized, thereby disengaging the bolt blocking device 62 from the translational element 60. This condition is shown in FIG. 4. At this instant, the translational element 60 is free to move laterally and any rotation of the handle 10 and associated shaft 14 extends or retracts the bolt 50. FIG. 4 shows the bolt 50 retracted into the lock 12, thus permitting the door 22 to be opened. Of course, the foregoing only describes a preferred embodiment; there are numerous other mechanisms known in the art to accomplish the same blocking and unblocking of the bolt.

Under power-off, standby conditions, the spring-loaded bolt blocking device 62 is preferably biased to engage the translational element 60 thereby maintaining the bolt 50 in the locked position, as shown in FIG. 3. Assuming the battery pack 16 has drained and no power is available, the present invention also features an optional pair of polarized contacts 66, located in the face plate 24. These contacts 66 are connected to the printed circuit board 26 and wired to the solenoid 52. Accordingly, even if the battery pack 16 is drained, under emergency conditions, a power source can be connected to the polarized contacts 66 to energize the electronics so that the proper code can be entered to retract the bolt 50 to unlock the door 22. The external power source can be a generator terminal or a simple nine-volt battery which has two terminals that conveniently mate with the polarized contacts 66.

The present invention combination lock further includes an optional power level indicator 68, nestled in the face plate 24. The power level indicator 68 may be a light emitting diode (LED), a liquid crystal display (LCD), or a like low power consumption device that indicates the voltage level of the battery pack 16. Through circuitry known in the art, when the battery pack 16 voltage drops below a threshold level, the power level indicator 68 can be illuminated. This would inform the user that the battery pack 16 should be replaced with fresh cells.

FIGS. 7, 8 and 9 provide various views of the handle housing 40. Notably, the back 70 of the housing 40 preferably includes two curved mounting slots 72, which facilitate assembly of the housing 40 to the door 22. Each curved mounting slot 72 further includes a resilient, cantilevered finger 74 that projects inward into the slot 72. At an end of each mounting slot 72 is a large opening 76 through which the head of a mounting screw 78 may pass. So during initial assembly of the housing 40 to the door 22, the screw head passes through the opening 76, and the housing 40 is then rotated. This changes the position of the curved mounting slot 72 relative to the immobile mounting screw 78. The mounting screw essentially translates along the slot 72.

In FIG. 7, when the housing 40 is rotated counterclockwise, the mounting screw 78 is translated passed the cantilevered finger 74, at which point the spring back in the cantilevered finger 74 biases the finger 74 inward toward the interior of the slot 72. This prevents the mounting screw 78 from translating along the slot 72 in the reverse direction. As a result, the housing 40 as shown in FIG. 7 cannot be rotated any farther in the clockwise direction because the cantilevered finger 74 has engaged the mounting screw 78. Conversely, the housing 40 can be rotated in the counterclockwise direction, simultaneously causing the mounting screw 78 to slide along the curved mounting slot 72.

Once the mounting screws 78 have translated past the cantilevered fingers 74, they are free to slide along the curved slot 72 and cannot slide back into the large openings 76. Once the housing 40 is assembled to the screws 78, the housing 40 cannot be disassembled by passing the screw head through the same openings 76.

Importantly, it is the rotation of the housing 40 that moves the shaft 14 which ultimately extends or retracts the bolt 50. The curved mounting slots 72 therefore permit easy assembly to the door but inhibits disassembly therefrom, while allowing the housing 40 to still rotate after assembly. A collar 80 positioned on the shaft 14 when mated to a lock washer 82 keeps the shaft 14 from being pulled out or pushed inward along its rotational axis.

Figure 6:
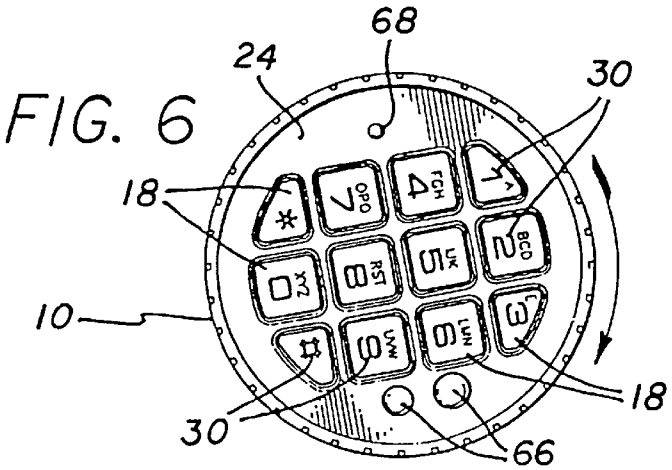
FIG. 6 is a front view of the dial indicating an open state of the lock.
Figure 5:
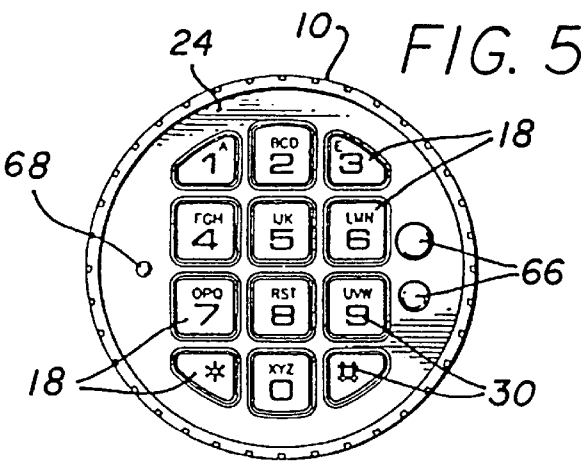
FIG. 5 is a front view of the dial indicating a closed state of the lock.

As best seen in FIGS. 5 and 6, the handle 10 includes indicia 30 positioned on the push buttons 18. When the handle 10 rotates, the indicia 30 rotate. Using the orientation of the indicia 30 as a visual cue, it is thus possible for the user to immediately recognize the open condition or closed condition of the bolt 50.

For example, when the handle 10 is in its upright state with the indicia 30 in their upright position, the bolt 50 is in its extended position as shown in FIG. 3. On the other hand, when the handle 10 is rotated clockwise, the indicia 30 assume a different orientation thus informing the user that the bolt 50 has been retracted.

Figure 12:
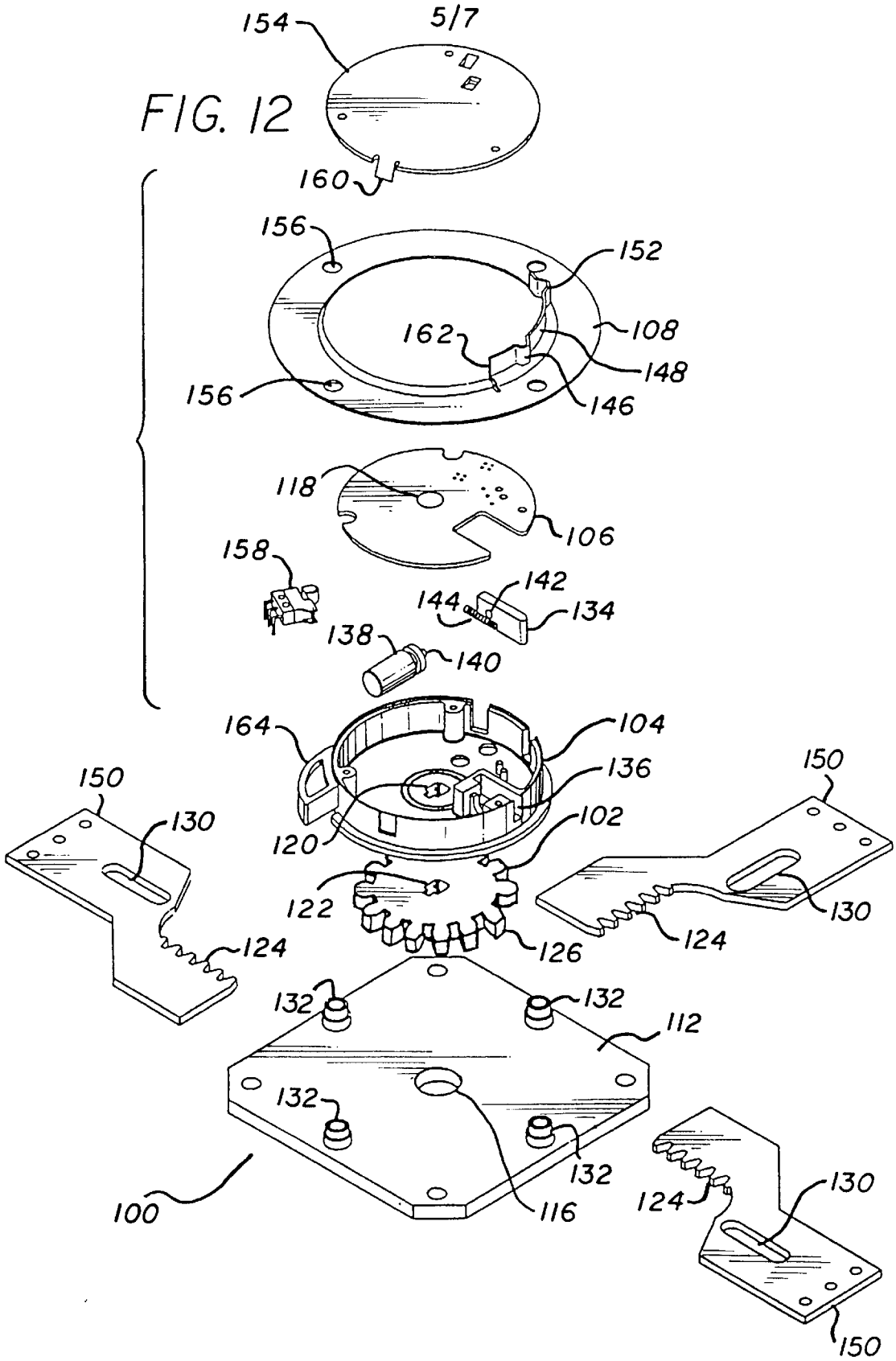
FIG. 12 is a perspective, exploded view of a preferred embodiment boltworks mechanism as shown in FIGS. 10 and 11.

In an alternative embodiment of the present invention, the electronic lock with a digital keypad incorporated into the handle as shown in FIGS. 1–9 is adapted for use with multiple bolts in a boltworks mechanism shown in FIGS. 10–12. Specifically, FIGS. 10 and 11 are perspective views of the present invention electronic lock with a digital key pad incorporated into the handle, wherein FIG. 10 shows the plurality of bolts in a retracted state and FIG. 11 shows the plurality of bolts in an extended state.

As shown in FIG. 10, the present invention provides a handle 110 attached to a shaft 114 to rotate the latter in order to actuate the bolts, as in the preceding embodiments. The handle 110 includes a keypad with alphanumeric indicia as in the preceding embodiments. Furthermore, the handle 110 is fashioned into a round dial-shape with ridges 128 spaced about the circumference. The ridges 128 provide a gripping surface to rotate the handle 110, which in turn, turns the shaft 114 to operate the boltworks 100.

As seen in FIGS. 10 and 11, rotating the handle 110 operates the boltworks 100 to extend or retract the three bolts 150. FIG. 12 provides an exploded view of an exemplary embodiment of the boltworks 100, shown in FIGS. 10 and 11. In FIG. 12, the handle 110 and shaft 114 have been omitted for the sake of clarity, but it is clear that the shaft extends through the centerline of the major components.

The boltworks 100 preferably comprises a gear 102, a rotatable member 104, a printed circuit board 106, and an immobile frame 108. These major components are aligned on a plate 112. The plate 112 can be mounted to a safe door, hotel room door, gate, or any like fixture. The plate 112 can also represent a part of the door itself.

When assembled, the gear 102 and rotatable member 104 are journalled on the shaft 114, which is preferably splined so that rotation of the shaft 114 generates concurrent rotation of the gear 102 and rotatable member 104. The shaft 114 passes through opening 116 in the plate 112 and opening 118 in printed circuit board 106. Keyed holes 120, 122 in the rotatable member 104 and the gear 102, respectively, ensure that the latter components rotate along with the splined shaft 114. Rotational motion of the handle 110 is transferred through shaft 114 to the gear 102 and the rotatable member 104.

In the exemplary embodiment shown in FIG. 12, there are three bolts 150 arranged at right angles. Of course, there can be fewer or more bolts arranged in a variety of configurations known in the art. Each bolt 150 includes a rack 124 that engages the teeth 126 of gear 102. Each bolt 150 features a slot 130 to receive a corresponding boss 132 protruding from the surface of the plate 112.

When the bolt 150 is assembled to the plate 112, the boss 132 passes through the slot 130. Therefore, when the handle 110 is rotated, the gear 102 rotates therewith and the teeth 126 travel along the corresponding racks 124 of each bolt 150. The travel of the rack 124 along teeth 126 moves the bolt 150, and the boss 132 sliding within slot 130 ensures that the bolt 150 moves along a radial direction.

In the preferred embodiment, the rotatable member 104 includes a mechanism to selectively engage the immobile frame 108 to prevent rotation of the rotatable member 104, thus immobilizing the shaft 114 as well. Specifically, in the exemplary embodiment shown, the rotatable member 104 further comprises a sliding dog 134 that slides within slot 136 formed in the outer circumference of the rotatable member 104. A solenoid 138 is positioned adjacent to the dog 134 within the rotatable member 104. A pin 140 selectively extends from or retracts into the solenoid 138, depending upon whether the solenoid 138 is energized or not. A corresponding hole 142 is designed to receive the pin 140 when it is extended thus locking the dog 134 in position.

When the exemplary embodiment of the present invention is in the locked state, the dog 134 protrudes out of the rotatable member 104 under the bias of a spring 144. The pin 140 is extended at this instant and plugs into hole 142. When the solenoid 138 is energized, the pin 140 retracts and through external pressure, the dog 134 can be forced against the bias of spring 144 inward to retract the dog 134 into slot 136. This allows the rotatable member 104 to turn freely to achieve the unlocked state.

When the dog 134 is in the extended, protruding position, the tip thereof engages a groove 146 or detent formed into a guide 148 disposed on the immobile frame 108. With the dog 134 engaging the groove 146, the rotatable member 104 is mechanically locked to the immobile frame 108, thereby preventing rotation of the rotatable member 104. Because the rotatable member 104 is interlocked with the splined shaft 114, the shaft 114 cannot be rotated. As a result, the handle 110 and the gear 102 cannot be rotated, thus freezing the bolts 150 in either their extended state or retracted state. In the preferred embodiment, the bolts 150 are locked when in their extended state.

After the correct combination is entered into the keypad on the handle 110, the solenoid 138 is energized to retract pin 140, thus freeing the dog 134. From this moment on, it is possible to retract the protruding dog 134 against the bias of the spring 144. Therefore, rotating the handle 110 turns the rotatable member 104, which motion correspondingly slides the dog 134 out of groove 146 and toward groove 152. During this rotational translation of the dog 134, the tip of the dog 134 encounters guide 148 which is sloped with a decreasing radius to slowly translate the dog 134 back into slot 136.

During this same motion, rotation of the shaft 114 rotates the gear 102. The rotating gear 102 in turn displaces rack 124 of the bolt 150 to extend or retract the bolt. In the preferred embodiment, as the dog 134 moves into groove 152, the bolts 150 are fully retracted. Optional groove 152 serves as a detent to indicate the limit of travel as the handle 110 is rotated.

A printed circuit board 106 contains electronic circuitry known in the art for deciphering the keypad entry code and for generating an electrical impulse to operate the solenoid 138. A battery (not shown) connected to the printed circuit board 106 powers the electronics. The printed circuit board 106 is held inside the rotatable member 104, and is protected by a cover 154.

The present invention therefore preferably operates as follows. In the locked position, the bolts 150 are extended and the dog 134 is extended and engaging groove 146. Pin 140 of solenoid 138 is held inside hole 142 of the dog 134. When assembled to the plate 112, holes 156 are aligned with bosses 132. Therefore, when the dog 134 is engaging groove 146, the rotatable member 104 cannot turn relative to the immobile frame 108, because the latter is mounted to plate 112 which is stationary. The splined shaft 114 is accordingly held in place and cannot rotate. The locked state is shown in FIG. 11.

A user enters a key combination through the keypad of the handle 110 as in the previous embodiment. The code is read by the circuitry of the printed circuit board 106, which then energizes the solenoid 138 to retract pin 140. This releases dog 134. When the user twists the handle 110, the rotational motion is translated to the rotatable member 104, which motion causes the dog 134 to slide out of groove 146 and along guide 148, which guide 146 eventually forces the dog 134 into the slot 136.

Simultaneously, rotation of the shaft 114 rotates the gear 102, which pulls the bolts 150 radially inward through the respective racks 124. With the bolts 150 in the retracted position, the lock is open as shown in FIG. 10.

An optional position switch 158 is mounted inside the rotatable member 104 to indicate the orientation of the rotatable member 104. This information is passed to the electronic circuitry, and can be shown on an optional display panel in the handle 110.

Cover 154 includes an optional tab 160 which can be bent outward. If the tab 160 is bent outward, it serves as a stop to prevent over-rotation of the entire mechanism. In particular, the outwardly bent tab 160 rotates into contact with the leading edge 162 of the immobile frame 108 when the handle 110 is turned to open the lock. This is shown in FIG. 10. With the tab 160 bent outward, the tab stops rotation of the rotatable member 104 so that the dog 134 never reaches groove 152. As a result, handle 110 remains free to rotate and the dog 134 may be slid back into groove 146.

On the other hand, if the tab 160 is bent downward, it passes underneath the leading edge 162, and the dog 134 travels along guide 148 until it encounters groove 152, which again permits the dog 134 to extend out of slot 136. This locks the rotatable member 104 to the immobile frame 108. This also locks the handle 110 in the open position. The aforementioned feature of maintaining the lock in the open state is sometimes useful in hotel safes when the room is vacant and the safe should remain unlocked for the next guest.

An optional secondary bolt 164 disposed on the outer circumference of the rotatable member 104 can be used to operate other linkages or levers in the lock. Thus, the rotational motion of the rotatable member 104 can be used to actuate other mechanical functions through secondary bolt 164.

Figure 13:
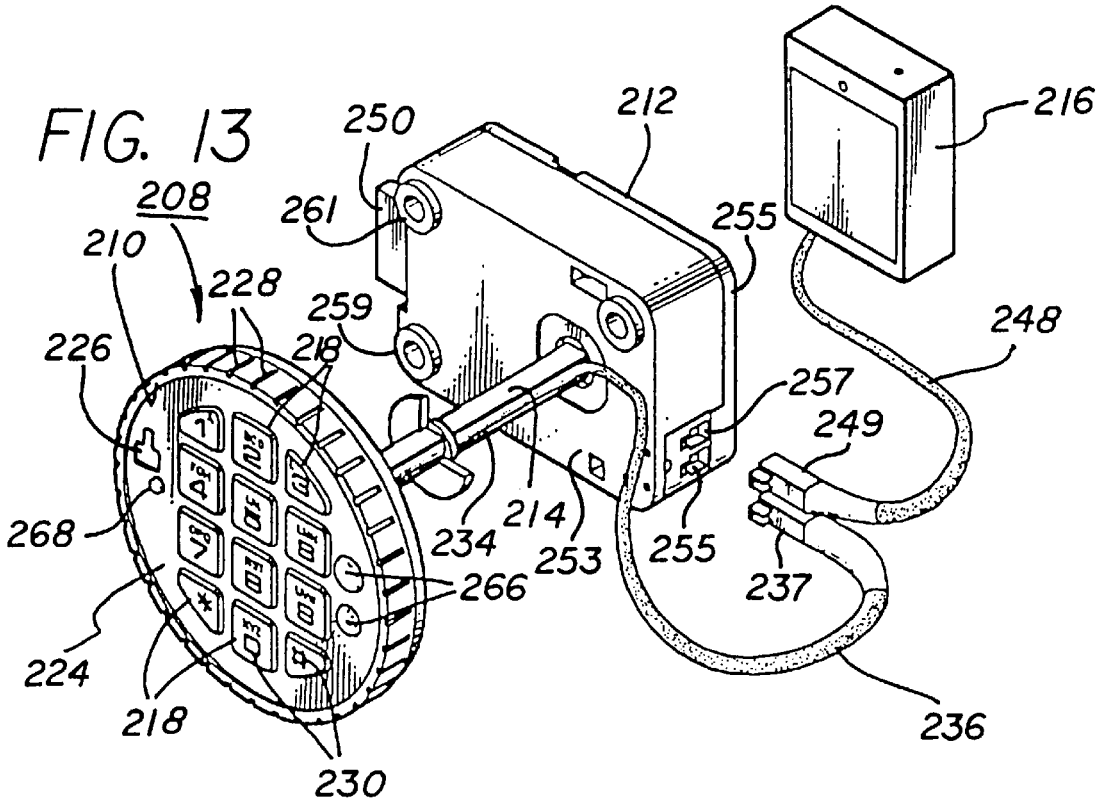
FIG. 13 is a pictorial view of an electronic combination lock which is constructed in accordance with the present invention.

Referring now to the drawings and more particularly to FIG. 13 thereof, there is shown an electronic combination lock arrangement 208 which is constructed in accordance with the present invention. The combination lock arrangement 208 is adapted to be mounted to an access such as a safe, a vault door, a security gate, and other types and kinds of entranceways.

The combination lock arrangement 208 generally includes a rotatable handle keypad assembly 210 which is coupled via a shaft 214, to an electronically actuated lock assembly 212. The electronically actuated lock assembly 212, is powered by a battery pack 216 via a power cable 248. The rotatable handle keypad assembly 210 includes a keypad assembly 215 having a keypad 238 with a set of pushbuttons, such as the pushbuttons 218, which are mechanically and electrically connected to a printed circuit board 226 which is disposed behind a face plate 224. A power/control signal cable 236 which is carried in a recessed slot 234 in the shaft 214, provides power to the printed circuit board 226 and carries a solenoid actuation or control signal to the lock assembly 212 as will be described hereinafter in greater detail.

In order to enable a user to identify the appropriate pushbuttons for entry of a combination code, each of the pushbutton 218 carry indicia 230. The indicia 230 is substantially centered on each of the pushbuttons 218 in an upright manner. In this regard, should a user enter a correct combination code and grasp the handle 210 by its external ridges 228 and rotate the assembly 210 about the shaft 214, the keypad assembly 215 will also rotate about the shaft 214. In this manner, a user will be able to view the orientation of the indicia 230 relative to a fixed reference, such as a vault or safe door and immediately recognize whether the handle 210 has been rotated from a closed to an open position.

To provide a user with a visual indication of the sufficiency of the electrical power provided by the battery pack 216, the lock arrangement 208 also includes a power level indicator 268 which is connected to the battery pack 216 via the printed circuit board 226 and cables 236 and 248 respectively.

The lock arrangement 208 also includes a set of battery or power contacts 266 that have a positive and negative polarity indicia (not shown) disposed thereon to provide a user with a correct polarity orientation should an external power source be required to energize the lock arrangement 208.

As the electronic lock arrangement 208 is substantially similar to the electronic lock of FIG. 1, except for the lock assembly 212, only the lock assembly 212 will be described hereinafter in greater detail.

Figure 14:
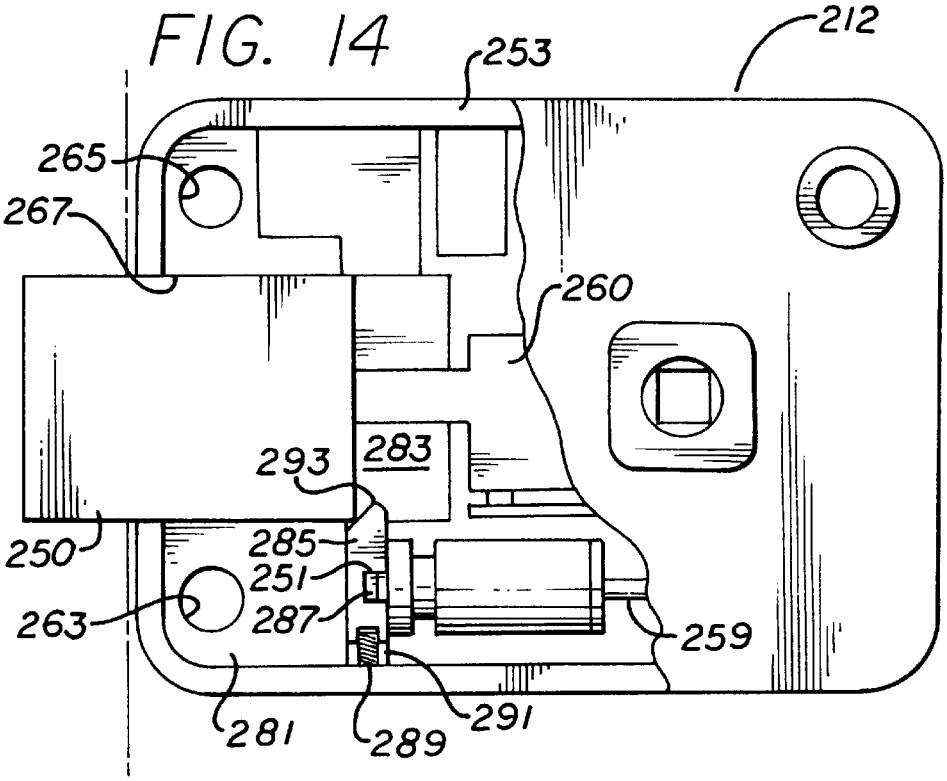
FIG. 14 is a cut-away side elevational view of the lock assembly of FIG. 13.

Considering now the lock assembly 212 in greater detail with reference to FIGS. 13 and 14, the lock assembly 212 generally includes a housing 253 having a support cover 255 that facilitates supporting a bolt block 281 mounted within the housing 253 by a pair of pins 259 and 261 that are threadably received in the support cover 255. In order to permit the bolt block 281 to be held in a fixed location by the pins 259 and 261 relative to the housing 253, the bolt block 281 includes a pair of apertures 263 and 265 which are dimensioned for receiving the pins 259 and 261 respectively.

As best seen in FIG. 14, the bolt block 281 includes an opening or passageway 267 that supports therein for relative rectilinear movement a bolt 250 that slides between an open and a close position. The bolt 250 is mechanically connected to a translation element 260 that is turn, is coupled to the shaft 214 to facilitate the rectilinear movement of the bolt 250 in response to the rotational turning of the rotatable assembly 210.

A bolt receiving space 283 is dimensioned for receiving the proximal end portion of the bolt 250 when it slides into the housing 253 in the open position. As best seen in FIG. 14, a spring biased pawl or dog 285 having a centrally disposed solenoid pin receiving detent hole 251, extends upwardly into the space 283 to block the movement of the bolt 250 when the pawl 285 is held in a fixed or locked position by a solenoid pin 287 received in the hole 251 under the control of a solenoid 252.

As best seen in FIG. 14, the pawl 285 is mounted within the housing 253 for rectilinear movement along a path that intersects the rectilinear path of travel followed by the bolt 250. In this regard, the pawl 285 is mounted substantially between the bolt block 281 and the solenoid 252 and is supported from below by the housing 253 and a pawl spring 289. The spring 289 biases the pawl 285 so that its distal end 293 projects outwardly into the space 283 to block the path of the bolt 250. The pawl 285 is configured to slide downwardly into a pawl receiving space 291 as the bolt 250 is pulled into the housing 253 while the bolt 250 cams along the camming surface of the distal end 293 of the pawl 285.

When the bolt 250 moves into its close position under the force of the translation element 260, the pawl spring 289 urges the pawl 285 upwardly into the bolt receiving space 283 causing the solenoid pin receiving hole 251 to come into alignment with the solenoid pin 287. In this manner, when the solenoid 252 is actuated, the pin 287 is received in the hole 251 to lock the pawl 285 in a fixed position.

In order to control the solenoid 252 via the solenoid actuation signal, the lock assembly 212 further includes a set of electrical contacts 255 and 257 that mechanically and electrically receive a corresponding set of electrical contacts 237 and 249 associated with the cables 236 and 248 respectively. The electrical contact 255 couples the control signal from the keypad assembly 215 to a solenoid signal wire 259 which is electrically connected to the solenoid 252 mounted within the housing 253.

As the mechanical operation of the translational element 260 relative to the shaft 214 is substantially identical to the operation of the lock 12, such operation will not be described herein after in greater detail. Similarly since the electrical operation of the solenoid 252 is substantially similar to the operation of the solenoid 252, the operation of the solenoid 252 will not be described in greater detail.

Figures 15, 16, 17:
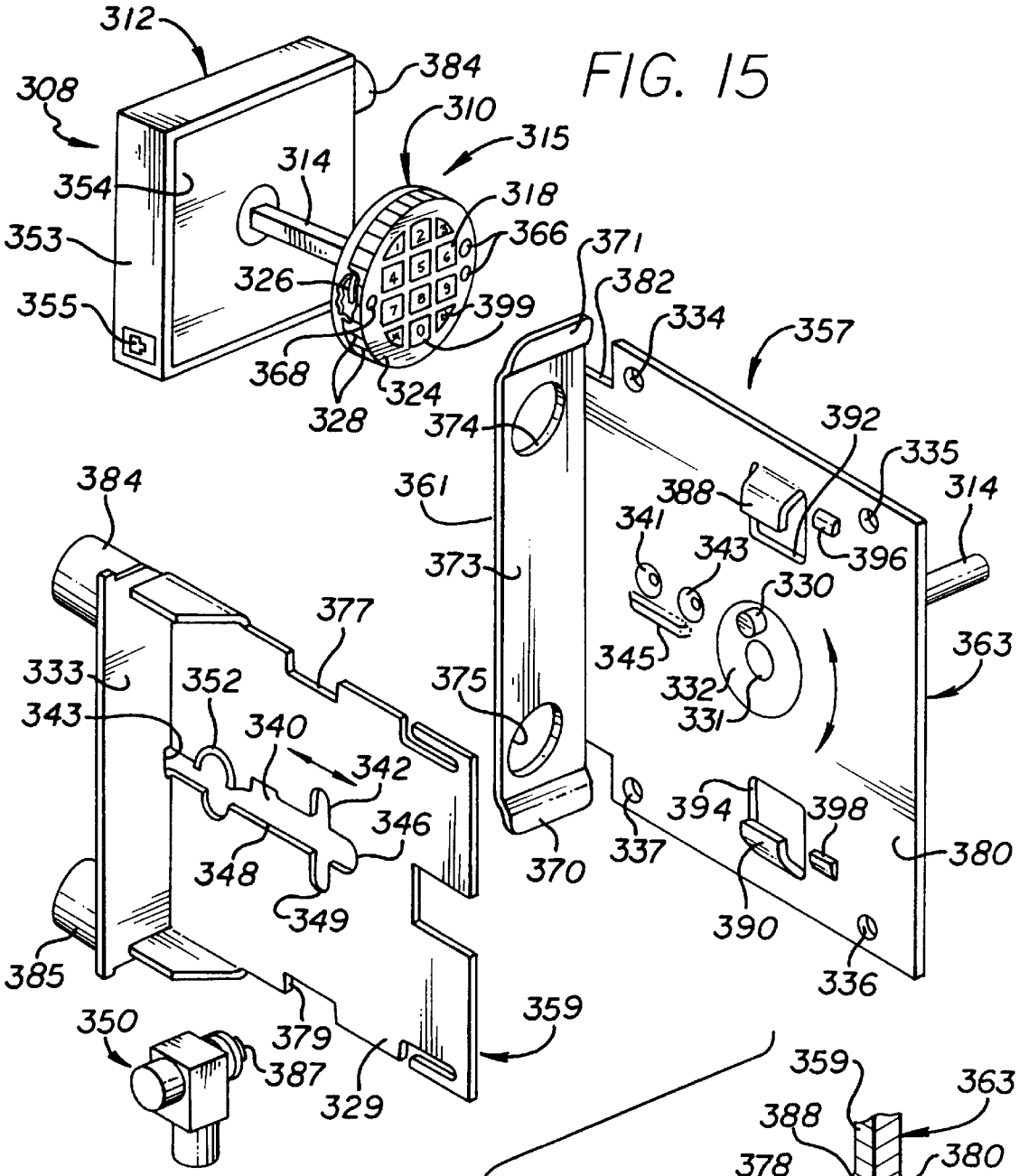
FIG. 15 is a pictorial view of an electronic combination lock which is constructed in accordance with the present invention.
FIG. 16 an exploded perspective view of the lock assembly within the lock housing of FIG. 15.
FIG. 17 is a fragmentary cross-sectional side elevational view of a solenoid panel assembly of FIG. 16.

Referring to the drawings and more particularly to FIG. 15, there is shown an electronic combination lock arrangement 308 which is constructed in accordance with the present invention.

The combination lock arrangement 308 generally includes a rotatable handle keypad assembly 310 which is coupled via a cam spindle or shaft 314 to an electronically actuated lock assembly 312. The electronically actuated lock assembly 312 includes a power jack 355 that is adapted to receive a power cable from a battery pack such as a power cable 48 and power pack 16 as illustrated in FIG. 1.

The rotatable assembly 310 includes a keypad assembly 315 having a keypad 338 with a set of pushbuttons, such as the pushbutton 318, which optionally bear 399 and are mechanically and electrically connected to a printed circuit board 326 which is disposed behind a face plate 324.

An elongated power control bus (not shown) is disposed within the interior of the shaft 314 to carry power to the keypad assembly 315 and to carry an actuate solenoid control signal from the keypad assembly 315 to the lock assembly 312. The rotatable assembly 310 includes a pair of power contacts 366 and power level indicated 368. As the rotatable assembly 310 and keypad assembly 315 are substantially similar to handle 10 and keypad assembly 215, they will not be described hereinafter in greater detail.

Considering now the electronically actuated lock assembly 312 in greater detail with reference to FIGS. 15–17, the lock assembly 312 generally includes a housing 353 having a face plate 354, which is adapted to support a base plate 357 in a fixed position within the interior of the housing. A sliding bolt plate 359 is mounted slidably to the base plate 357 and moves along a rectilinear path of travel between open and close positions in response to a user rotating the handle 310 following the entry of a correct combination code.

As will be described hereinafter in greater detail, a solenoid pawl assembly 350 responsive to the solenoid actuation control signal, is mounted to the bolt plate 359 and locks the bolt plate 359 in a fixed open position or in a fixed closed position relative to the base plate 357.

Considering now the base plate 357 in greater detail with reference to FIG. 16, the base plate 357 has a unitary construction and includes a bolt guard plate 361 which is integrally connected at about a 90 degree angle to a support plate 363. The support plate 363 includes a set of mounting hole 334–337 which are dimensioned for receiving mounting screws (not shown) to mount the base plate 357 to the face plate 354 in a fixed position.

Considering now the bolt guard plate 361 in greater detail with reference to FIG. 16, the bolt guard plate 361 has a general rectangular shape having inwardly bent end portions 370 and 371 which are integrally connected at opposite ends of a stop plate 373 that limits the rectilinear path of travel followed by the bolt plate 359. The stop plate 373 includes a pair of spaced apart bolt receiving holes 374–375 that are respectively dimensioned for receiving an individual one of a set of locking bolts 384–385 which are integrally connected to the sliding bolt plate 359.

Considering now the support plate 363 in greater detail with reference to FIG. 16, the support plate 363 has a general rectangular shape that includes a slide plate support member 380 having an outwardly projecting integrally connected tab member 382 disposed at one of its ends which is integrally connected at its longitudinal edge to the stop plate 373.

A pair of arcuate shaped support tabs or ears 388 and 390 project outwardly from a corresponding set of generally rectangular shaped holes 392 and 394 respectively. The tabs 388 and 390 are spaced apart from one anther a sufficient distance D to permit the sliding bolt plate 359 to be received and supported therebetween. A set of stops 396 and 398 are disposed rearwardly of the tabs 388 and 390 respectively for limiting the rearward travel of the bolt plate 359 relative to the base plate 363.

In order to translate the rotational action of the cam spindle 314 to horizontal rectilinear movement by the sliding bolt plate 359, a wheel 332 is mounted rotatably within the support member 380. The wheel 332 has a centrally disposed journalled hole 331 that is dimensioned to receive therein in a friction tight fit, the spindle 314. A driving cam 330 projects outwardly from the wheel 332 and is disposed in a substantially parallel orientation relative to the spindle 314. As will be explained hereinafter in greater detail, the cam 330 is adapted to engage a camming slot 338 disposed in the slidable bolt plate 359 to cause it to move in a rectilinear path of travel.

In order to facilitate locking the sliding bolt plate 359 in a fixed position relative to the support plate 363, the support plate 363 includes a pair of generally conically shaped recessed detents or grooves 341 and 343 that are sufficiently deep to receive in locking engagement a spring biased pawl or dog 387 that is actuated under the control of a solenoid 351 as will be explained hereinafter in greater detail. A solenoid pawl assembly support bar 345 projects outwardly from the support member 380 slightly below the grooves 341 and 343. The support bar 345 supports from below a front portion of the solenoid pawl assembly 350 indicated generally at 347.

Considering now the slidable bolt plate 359 in greater detail with reference to FIG. 16, the slidable bolt plate 359 has a unitary construction that includes a bolt support member 333 which is integrally connected at about a 90 degree angle to a translation member 329. The bolt support member 333 has projecting outwardly from its face the bolts 384 and 385 which are spaced apart from one another at about the ends of the member 333.

Considering now the translation member 329 in greater detail with reference to FIG. 16, the translation member 329 has a width (W) which is dimensioned to be received between the ears 388 and 390 of the base plate 363 as will be explained hereinafter in greater detail. In order to facilitate mounting the slidable bolt plate 359 to the base plate 363, the translation member 329 has a pair of cut out 377 and 379 which are disposed at its upper and lower edges respectively.

An elongated camming slot 340 is disposed in the translation member 329 and extends rearwardly from a centrally disposed front edge portion 343 abutting the bolt support member 333, a sufficient distance to permit engagement with the drive cam member 330 when it is disposed at its open position at about a 3:00 p.m. position on the wheel 332. In this regard, the drive cam receiving portion of the slot 340 has a papal cross like configuration that include a pair of opposed narrow slot members 342 and 349 respectively, a wide short end slot portion 346, and a wide elongated cam disengagement slot portion 348 which is opposed to the short end portion 346.

A solenoid housing receiving boss 352 projects outwardly from the slot 340 between the cam disengagement slot portion 348 and the front edge portion 343 and is dimensioned for receiving therein a friction tight fit the solenoid pawl assembly 350. In this regard, when the assembly 350 is mounted in the boss 352, the assembly 350 is carried along the same rectilinear path of travel followed by the bolt plate 359. In this manner, the lockable pawl 387 is able to engage both the forward or closed position detent recess 341 and the rear or open position detent recess 343 disposed in the base plate 363. From the forgoing it should be understood by those skilled in the art that the lock 312 can be locked in both an open position and a closed position so that a correct combination code must be entered to open the lock arrangement 310 so the bolt plate 359 and its associated bolts 384 and 385 are retracted into the interior of the lock assembly 312 in a locked position. In a like manner, a correct code must be entered to close the lock arrangement 310 so the bolt plates bolts 384 and 385 are projected outwardly from the interior of the lock assembly 312 into a locked position.

Considering now the solenoid pawl assembly 350 in greater detail with reference to FIGS. 16 and 17, the solenoid pawl assembly 350 generally includes a solenoid pawl housing 364 which is adapted to be snapped into the boss 352 in a friction tight fit. A spring 367 urges the pawl 387 outwardly from the housing 364 to enable the pawl 387 to be received within an appropriate one of the recess detents 341 and 343. A solenoid 351 having a solenoid pin 376 engages a pawl detent or groove 378 which is disposed between the proximal and distal ends of the pawl 387. In regard, when the solenoid 351 is actuated, the pin 376 is retracted permitting the spring 367 to urge the pawl 387 outwardly from the housing 364 to freely cam against the base plate 363 and be received within one of the recess detents 341 and 343.

As best seen in FIG. 17, when the pawl 387 is received within one of the detent recesses, such as the recess 343, the solenoid pin 376 becomes aligned with the detent groove 378 permitting the solenoid 351 to be actuated to lock the pawl 387 in place.

Considering now the operation of the translation member 335 relative to the drive cam 330, in a bolt retracted position, the drive cam 330 is disposed within the slot 348. As the user rotates the handle 310 in a counter clockwise direction, the cam 330 travels upwardly and is received in slot 342 causing the bolt plate 359 to move in a rearwardly direction as the user continues to rotate the handle 310 a sufficient distance to cause the drive cam 330 to be received in the slot 346. In this rearward position, the pawl 387 is received in the detent 343 permitting the solenoid pin 376 to engage the detent 378 to lock the pawl 387 in the detent 343 to effectively lock the bolt plate 359 to the base plate 357.

The user may then reverse this operation by again entering a correct combination code to retract the solenoid pin 376 from the detent 378 followed by rotating the handle 310 in a clockwise direction. Rotating the handle 310 in a clockwise direction enables the bolt plate 359 to slide forward to extend the bolts 384 and 385 outwardly form the lock assembly 212 and to align the pawl 387 with the forward detent 341 as it is urged outwardly into the recess 341 by the spring 366. Again, the solenoid pin 376 is aligned with the detent 378 permitting the pawl 387 to be locked in position once again.

A unique feature of the cam slot 340 is the papal configuration that allows the slide bolt plate 359 to move relative to base plate 363 regardless of whether the handle 310 is rotated in a clockwise or counter clockwise direction. Thus for example, if the pawl 387 is in engagement with recess 341, the user may enter a correct combination code to cause the solenoid 351 to retract its pin 376 allowing the rotation of the handle 310 to cause the bolt plate 359 to move relative to the base plate 363. In this example, the user rotates the handle 310 in a counter clockwise direction permitting the drive cam 330 to be received in the bottom slot 349. As the user continues to rotate the handle in the counter clockwise direction, the drive cam 330 forces the plate 359 rearwardly until the cam 330 is received in the slot 346. Thus, the same rearward motion of the bolt plate 359 can be effected regardless of whether the user rotates the handle in a clockwise or counter clockwise direction.

The present exemplary embodiment utilizes a cam to operate the bolts. It is possible, however, to use a gear or mechanical linkages known in the art to obtain similar type translational motion of the multiple bolts.

Considering now the engagement of the bolt plate 359 with the base plate 357, the bolt plate 359 is aligned so that cam 330 is received in the slot 340 with the slots 377 and 379 disposed between ears 388 and 389 of the base plate 363. The bolt plate 359 is then slid forward to matingly engage the bolt plate 359 with the base plate 363.

While a particular embodiment of the present invention has been disclosed, it is to be understood that various different modifications are possible and are contemplated within the true spirit and scope of the appended claims. There is no intention, therefore, of limitations to the exact abstract or disclosure herein presented.

What is claimed is:

1. A combination lock, comprising:

a base plate having a rotatable cam member and a plurality of spaced apart detent hole members aligned along a common axis;

a bolt plate mounted slidably to said base plate for moving along a rectilinear path of travel substantially parallel to said common axis to block and unblock an entranceway in response to said cam member being rotated;

a rotatable electronic keypad coupled mechanically to said rotatable cam member for rotating said rotatable cam member about a common rotational axis with said keypad;

said rotatable electronic keypad having a plurality of pushbuttons for the entry of a sequence indicative of a correct combination code to facilitate the movement of said bolt plate from a blocking entranceway state to an unblocking entranceway state;

a lockable pawl member mounted to said bolt plate for engaging an individual one of said plurality of detent hole members to substantially prevent said bolt plate from moving along said rectilinear path of travel when said detent member is in a locked state;

said lockable pawl member having a detent groove to facilitate locking said pawl member in a fixed position;

a solenoid having a solenoid pin for engraving said detent groove to secure said pawl member in a locking engagement with an individual one of said plurality of detent holes to effectively prevent said bolt plate from traversing from entranceway blocking and unblocking states; and said solenoid being coupled electrically to said rotatable electronic keyboard and being responsive to said correct combination code for retracting said solenoid pin from said locking engagement to permit said bolt plate to move along said rectilinear path of travel in response to said electronic keypad being rotated about said common rotational axis.

2. A combination lock according to claim 1, wherein said base plate includes a pair of spaced apart plate support members for receiving therebetween for slidable rectilinear movement said bolt plate.

3. A combination lock according to claim 2, wherein said plate support members are tabs.

4. A combination lock according to claim 3, wherein said tabs are punched out from said base plate.

5. A combination lock according to claim 2, further comprising an elongated rotatable member coupled between said rotatable cam member and said rotatable electronic keypad for defining the common rotational axis between the rotatable cam member and the rotatable electronic keypad.

6. A combination lock according to claim 5, wherein said elongated rotatable member is a shaft.

7. A combination lock according to claim 5, wherein said elongated rotational member includes a conductivity channel for electrically coupling said electronic keypad to said solenoid.

8. A combination lock according to claim 5, wherein said rotatable cam member includes:

a journalled wheel rotatably mounted to said base plate; and a protuberance projecting perpendicularly outwardly from said wheel for engagement with said bolt plate to cause said bolt plate to move along said rectilinear path of travel when said wheel is rotated.

9. A combination lock according to claim 8, wherein said journalled wheel has a journalled hole for receiving therein an end portion of said elongated rotatable member.

10. A combination lock according to claim 8, wherein said bolt plate includes at least one lock bolt for blocking and unblocking said entrance way.

11. A combination lock according to claim 9, wherein said bolt plate includes an integrally formed translation member for receiving said protuberance therein and for converting the rotational movement of said electronic keyboard about said common rotational axis into rectilinear movement.

12. A combination lock according to claim 11, wherein said translational member causes the same linear movement in response to both clockwise and counter clockwise rotational movement of said electronic keyboard.

13. A combination lock according to claim 11, wherein said translational member includes an open slot.

14. A combination lock according to claim 13, wherein said open slot has two opposing narrow portions and two opposing wide portions.

15. A combination lock according to claim 14, wherein said narrow portions have a width that is sufficiently small to engage said protuberance for relative movement.

16. A combination lock, comprising locking means comprising a base plate having a rotatable cam member and a plurality of spaced apart detent holes aligned along a common axis, and a blocking bolt plate mounted slidably to said base plate for moving along a first rectilinear path of travel substantially parallel to said common axis to block and unblock an entranceway in response to said rotatable cam member being rotated, said locking means movable along said first rectilinear path of travel between a blocked position and an unblocked position;

lockable detent means disposed in said first rectilinear path of travel such that said lockable detent means prevents said locking means from moving along said first rectilinear path of travel when said detent means is locked in a lockable position and allows said locking means to move along said first rectilinear path of travel when said detent means is unlocked in said lockable position, said lockable detent means movable along a second rectilinear path of travel between said lockable position and an unlockable position;

said locking means coupled to said lockable detent means such that said locking means causes said lockable detent means to move along said second rectilinear path of travel between said lockable position to said unlockable position when said locking means travels said first rectilinear path of travel between said blocked position and said unblocked position; and rotatable electronic means coupled electrically to said lockable detent means to unlock said detent means in response to a given electrical sequence indicative of a combination code and to permit the rotation of said rotatable electronic means about a rotational axis; and said rotatable electronic means coupled mechanically to said locking means such that said locking means responds to a rotation of said rotatable electronic means about said rotational axis for translating said rotation into a linear movement to move said lockable detent means to said unlockable position as said locking means travels along a substantial portion of said first rectilinear path of travel.

17. A combination lock according to claim 16, wherein said rotatable electronic means includes:

a rotatable electronic keypad coupled mechanically to said rotatable cam member for rotating said rotatable cam member about a common rotational axis with said keypad; and said rotatable electronic keypad having a plurality of pushbuttons for the entry of a sequence indicative of a correction combination code to facilitate the movement of said blocking bolt plate from a blocking entranceway state to an unblocking entranceway state.

18. A combination lock according to claim 17, wherein said lockable detent means includes:

a lockable detent member mounted to said blocking bolt plate for engaging an individual one of said plurality of detent holes to substantially prevent said blocking bolt plate from moving along said rectilinear path of travel when said detent member is in a locked state;

a solenoid having a solenoid pin for engaging and securing said detent member in a locking engagement with an individual one of said plurality of detent holes to effectively prevent said blocking bolt plate from traversing from entranceway blocking and unblocking states; and said solenoid being coupled electrically to said rotatable electronic keyboard and being responsive to said correct combination code for retracting said solenoid pin from said locking engagement to permit said blocking bolt plate to move along said rectilinear path of travel in response to said electronic keypad being rotated about said common rotational axis.

* * * * *